US009840989B2

(12) United States Patent
Newman et al.

(10) Patent No.: US 9,840,989 B2
(45) Date of Patent: Dec. 12, 2017

(54) SOFT ENGINE COVER FOR INTAKE MANIFOLD

(71) Applicant: Ford Global Technologies, LLC, Dearborn, MI (US)

(72) Inventors: Christopher W. Newman, Farmington Hills, MI (US); Christopher T. Snow, New Boston, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 115 days.

(21) Appl. No.: 14/954,227

(22) Filed: Nov. 30, 2015

(65) Prior Publication Data

US 2017/0152818 A1 Jun. 1, 2017

(51) Int. Cl.

| | |
|---|---|
| ***F02M 35/12*** | (2006.01) |
| ***F02M 35/104*** | (2006.01) |
| *F02B 77/11* | (2006.01) |
| *F02B 77/13* | (2006.01) |

(52) U.S. Cl.

CPC ..... *F02M 35/104* (2013.01); *F02B 77/11* (2013.01); *F02B 77/13* (2013.01); *F02M 35/1272* (2013.01); *F05C 2225/06* (2013.01); *F05C 2225/08* (2013.01)

(58) Field of Classification Search

CPC ..... F02B 77/13; F02B 77/11; F02M 35/1272; F02M 35/104; F05C 2225/06; F05C 2225/08

USPC ..... 123/198 E

See application file for complete search history.

(56) References Cited

U.S. PATENT DOCUMENTS

| | | | | |
|---|---|---|---|---|
| 4,788,950 | A * | 12/1988 | Finley | F02F 7/006 123/195 C |
| 5,932,353 | A | 8/1999 | Huarng et al. | |
| 6,302,074 | B1 * | 10/2001 | Bolsover | F02F 7/006 123/184.21 |
| 7,392,784 | B2 | 7/2008 | Yamasaki et al. | |

(Continued)

FOREIGN PATENT DOCUMENTS

| | | | |
|---|---|---|---|
| CN | 202279059 | U | 6/2012 |
| JP | 2004132219 | A | 4/2004 |

(Continued)

*Primary Examiner* — Jacob Amick
*Assistant Examiner* — Charles Brauch
(74) *Attorney, Agent, or Firm* — Gregory P. Brown; MacMillan, Sobanski & Todd, LLC

(57) ABSTRACT

A cover for an engine assembly of a motor vehicle is attached at one end by a hinge and at the other end by sockets interlocking with engine projections. The engine assembly has a first hinge portion located at a top, rearward end of the engine assembly, and has first and second structural projections extending upwardly and spaced from the first hinge portion. The cover has a foam body overmolded onto a rigid substrate. The substrate has an integral second hinge portion to engage the first hinge portion. The foam body is formed of polyurethane foam with first and second sockets releasably receiving the first and second projections, respectively, to hold the cover at an installed position. The soft cover provides excellent noise and vibration performance together with a desired visual appearance. Manual installation and removal of the cover is done easily and without any tools or removable fasteners.

9 Claims, 9 Drawing Sheets

(56) References Cited

U.S. PATENT DOCUMENTS

| | | | | |
|---|---|---|---|---|
| 7,673,892 | B2 | 3/2010 | Kuntze et al. | |
| 8,851,690 | B2 | 10/2014 | Uken et al. | |
| 2004/0026424 | A1* | 2/2004 | Reustle | B60K 15/0406 220/378 |
| 2004/0108623 | A1 | 6/2004 | Deeter et al. | |
| 2006/0073310 | A1* | 4/2006 | Winkler | F02B 77/13 428/158 |
| 2008/0073813 | A1* | 3/2008 | Smith | B29C 45/14778 264/266 |
| 2011/0159247 | A1* | 6/2011 | Sugimoto | B32B 5/18 428/174 |
| 2012/0104784 | A1* | 5/2012 | Sapak | B60R 13/0206 296/1.08 |
| 2012/0108136 | A1 | 5/2012 | Elia et al. | |
| 2012/0292868 | A1* | 11/2012 | Goellner | B62B 1/14 280/47.19 |
| 2013/0082416 | A1 | 4/2013 | Wakeman | |

FOREIGN PATENT DOCUMENTS

| | | | |
|---|---|---|---|
| JP | 2004198801 | A | 7/2004 |
| JP | 2006183571 | A | 7/2006 |
| JP | 2006336743 | A | 12/2006 |
| WO | 2013108704 | A1 | 7/2013 |

* cited by examiner

SOFT ENGINE COVER FOR INTAKE MANIFOLD

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to decorative covers installed on internal combustion engines for automotive vehicles, and, more specifically, to the mounting of a soft engine cover to an engine and air intake manifold.

The engine compartment of a vehicle presents various challenges for vehicle engineers and designers in providing functionality, serviceability, and aesthetics in a relatively small space. Consideration must also be given to manufacturing and assembly costs in addition to weight, which ultimately impacts fuel economy, to deliver a competitive product. An engine cover is typically used in order to enhance the overall appearance of the engine compartment and to reduce the propagation of engine noise. Injection molded polymers are commonly used to fabricate an engine cover.

The typical mounting for an engine cover to an engine may be comprised of several steel brackets, fasteners, or other joining structures such as hooks or clamps. The use of several intermediate components which attach on one side to the engine cover and on the other side to an engine component (e.g., an air intake manifold or a cam cover) creates many potential sites for NVH (noise, vibration, and harshness) problems such as squeak and rattle. A relatively large part count leads to added part costs and an associated increase in manufacturing/assembly costs.

The air intake manifold which directs incoming air to the respective engine cylinders of a combustion engine has historically been fabricated from metal. More recently, various molded materials including thermoplastics, resins, and polymers have been used to manufacture intake manifolds. Preferred materials may include nylon or other polyamides which may further include filler materials such as glass fibers. A switch to plastic materials has achieved a reduction in weight, but reliance on brackets and fasteners with a high parts count have continued.

In co-pending U.S. application Ser. No. 14/525,578, filed Oct. 28, 2014, entitled "Integrally-Molded Intake Manifold Connector for Engine Cover of Combustion Engine," which issued as U.S. Pat. No. 9,464,607 on Oct. 11, 2016, and which is incorporated herein by reference in its entirety, a hinged connection is disclosed wherein hinge pins extending from radial arms of the engine cover each carry an elastomeric ferrule and wherein the hinge pins are received in slots formed by transverse strips carried by structural ribs of the manifold body.

In co-pending U.S. application Ser. No. 14/804,495, filed Jul. 21, 2015, entitled "Hinged Engine Cover for Intake Manifold," which issued as U.S. Pat. No. 9,551,307 on Jan. 24, 2017, and which is incorporated herein by reference in its entirety, a hinged interface is disclosed wherein C-hooks formed integrally on the intake manifold receive a hinge spindle that is an integrally molded element of the cover.

The engine cover is typically fabricated as a one-piece molded article to simplify manufacturing and to lower cost. In order to securely retain the engine cover throughout the service lifetime and harsh conditions in a vehicle, the hinge components must be fairly rigid. Consequently, a nylon or other hard thermoplastic material needed for the hinge element is used to form the entire cover. However, a hard material may be less effective at attenuating noise and vibrations.

In addition, fasteners used to secure the cover at the end opposite from the hinge have been relatively difficult to reach and/or manipulate during installation. Thus, it would be desirable to increase noise attenuation while providing an attachment that simplifies installation, reduces parts count, and lowers cost.

SUMMARY OF THE INVENTION

In one aspect of the invention, apparatus for a motor vehicle comprises an engine assembly having a first hinge portion located at a top, rearward end of the engine assembly, and having first and second structural projections extending upwardly and spaced from the first hinge portion. A cover comprises a rigid substrate and a foam body overmolded onto the substrate. The substrate has an integral second hinge portion to engage the first hinge portion. The foam body has first and second sockets releasably receiving the first and second projections, respectively, to hold the cover at an installed position. The composite engine cover obtains an attractive appearance and good noise absorption characteristics while combining a sufficiently rigid hinge attachment with a snap-in-place fastening system that functions without the need for any tools or removable fastener elements.

DETAILED DESCRIPTION OF PREFERRED EMBODIMENTS

Figure 1:
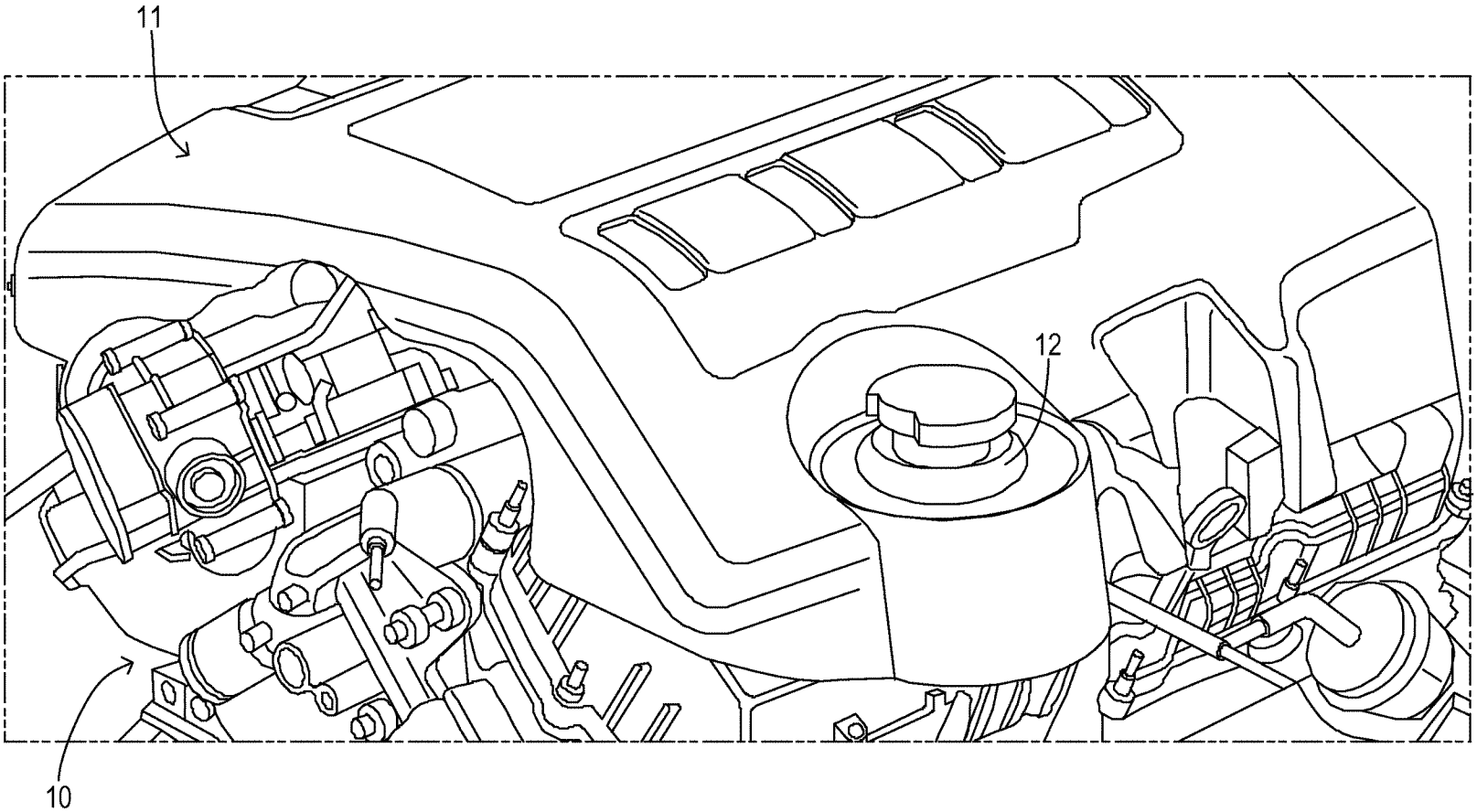
Fig. 1 (Prior Art)
FIG. 1 is a partial perspective view of a prior art engine and engine cover.

Referring to FIG. 1, an internal combustion engine 10 supports an engine cover 11. Conventionally, cover 11 is rigid and could be comprised of a molded polymeric material such as nylon, PVC, or polyurethane, for example. Cover 11 may include various details for accommodating features and accessories of engine 10, such as an oil port 12. Various brackets and/or fasteners are conventionally used to mount cover 11 to various structures of engine 10.

Figure 2:
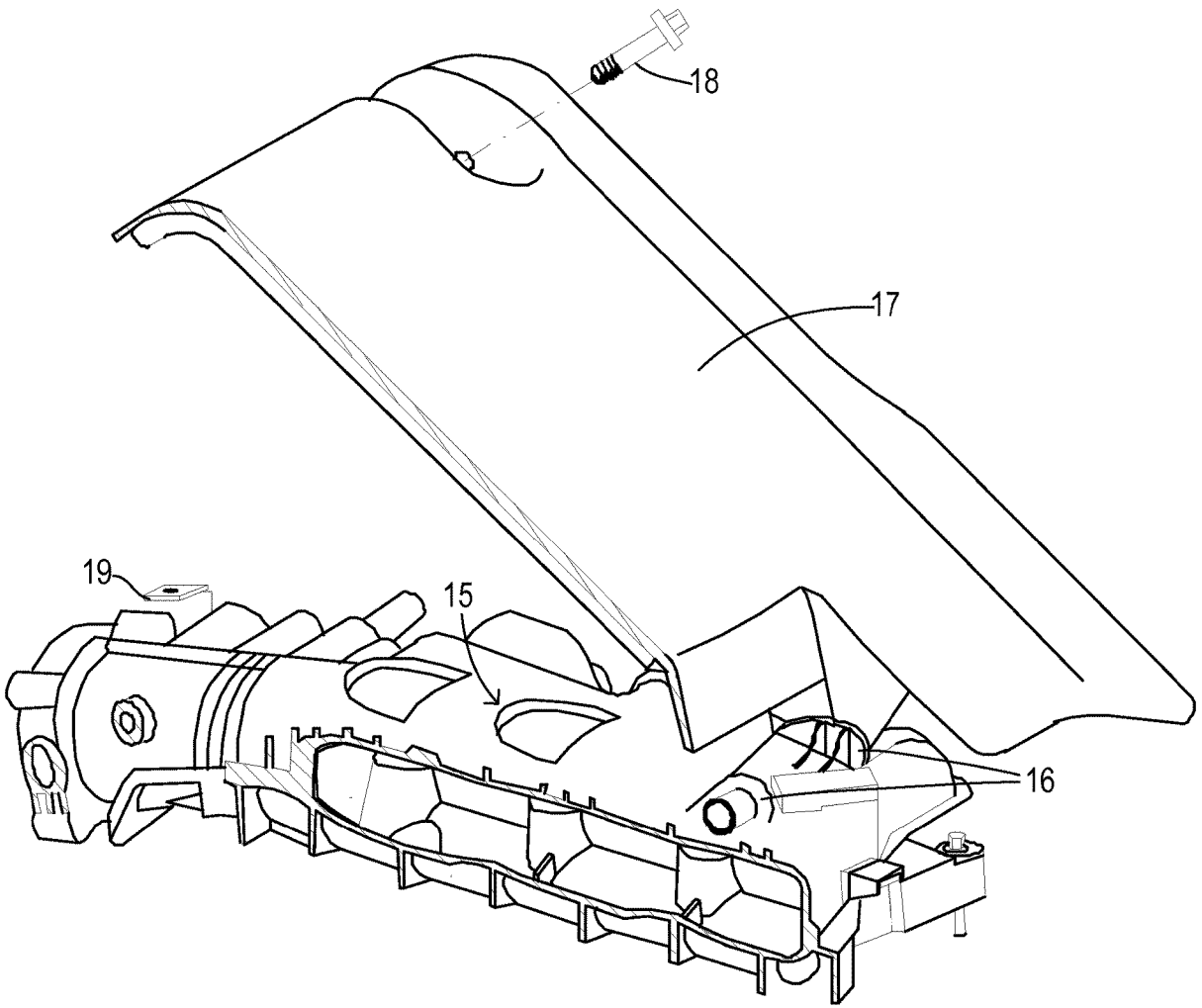
Fig. 2 (Prior Art)
FIG. 2 is a partial cross-sectional, perspective view of a hinged engine cover partially installed on an intake manifold body.
Figure 3:
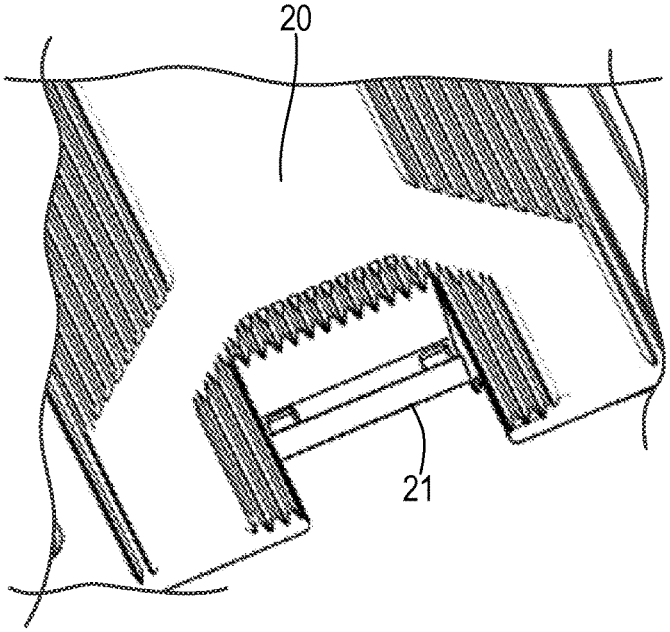
Fig. 3 (Prior Art)
FIG. 3 is a top, perspective view of a portion of a prior art molded engine cover including a spindle or pivot pin.
Figure 4:
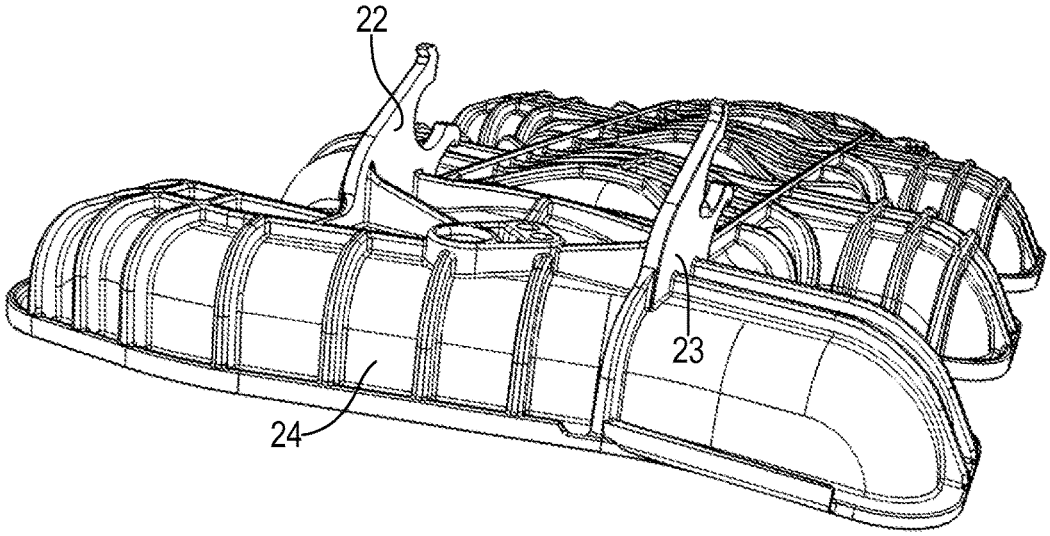
Fig. 4 (Prior Art)
FIG. 4 is a rear, perspective view of a portion of a prior art intake manifold including hinge C-hooks for receiving the pivot pin of a cover.
Figure 5:
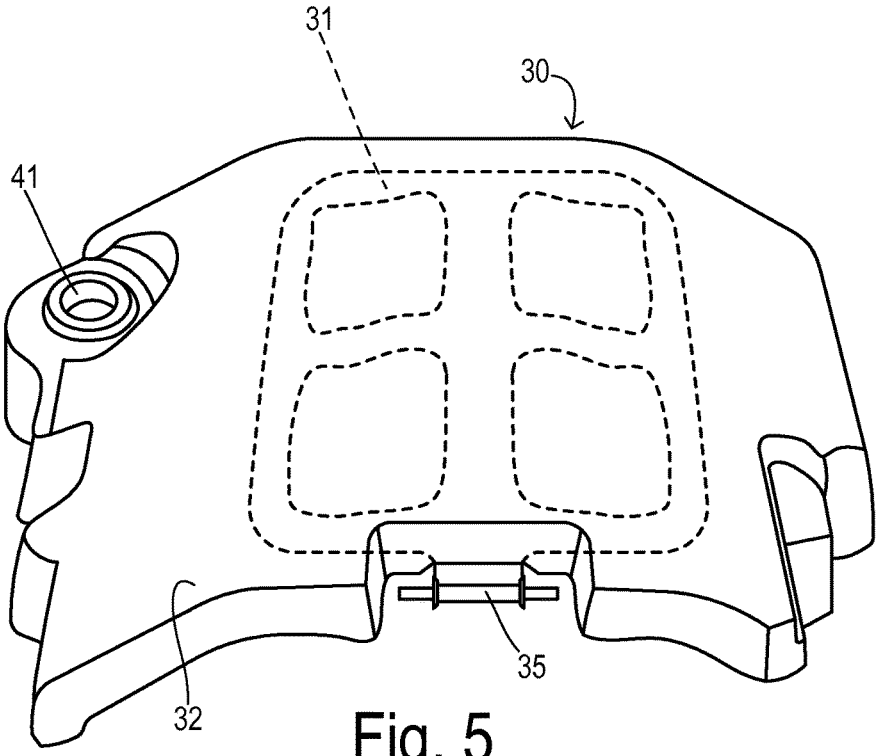
FIG. 5 is a perspective view of a composite engine cover according to one preferred embodiment of the invention.
Figure 9:
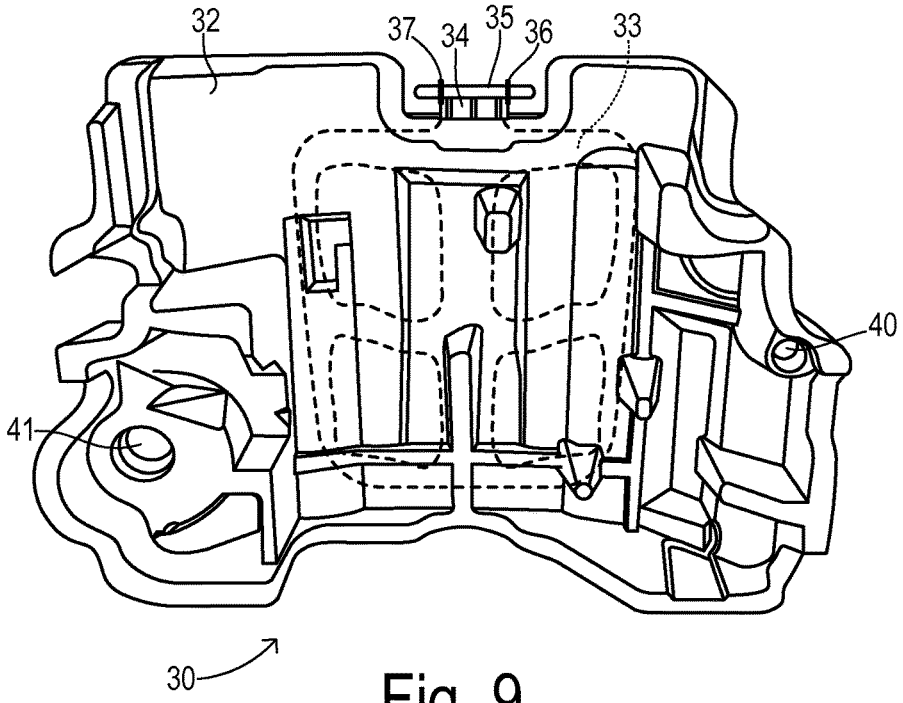
FIG. 9 is a bottom view of the composite cover showing sockets for connecting the cover with an engine assembly.
Figure 6:
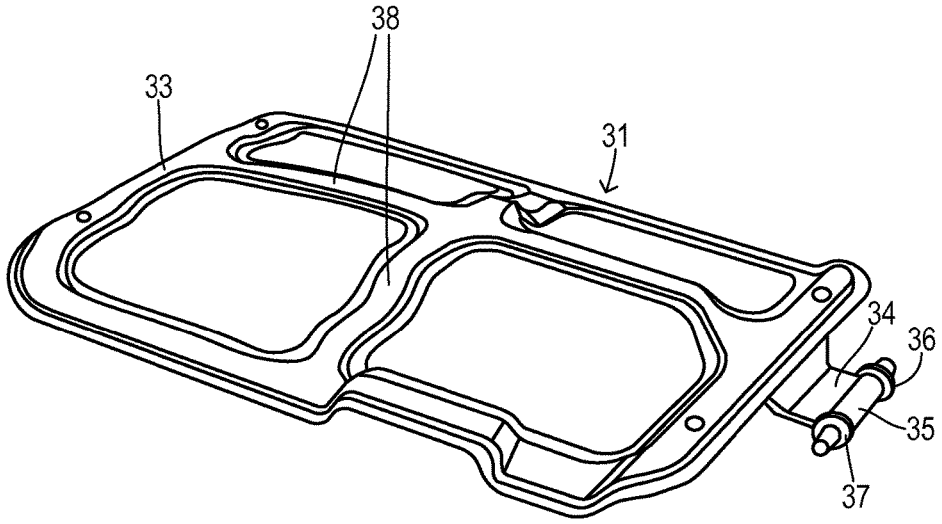
FIG. 6 is a perspective view of a molded substrate of the composite engine cover prior to overmolding.
Figure 7:
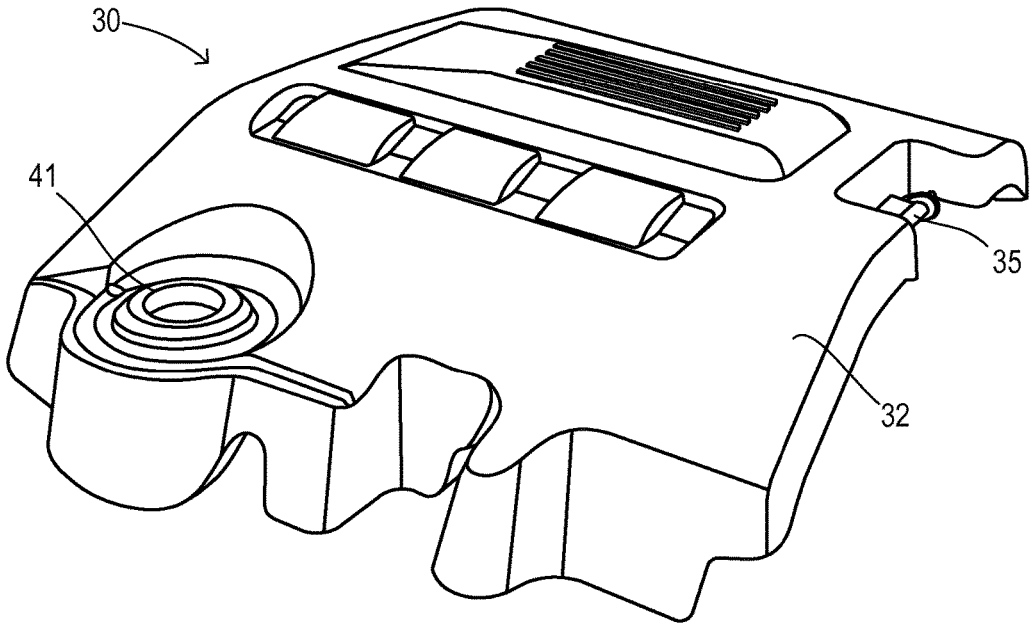
FIG. 7 is a perspective view showing the composite engine cover after overmolding of polyurethane foam over the substrate of FIG. 6.
Figure 8:
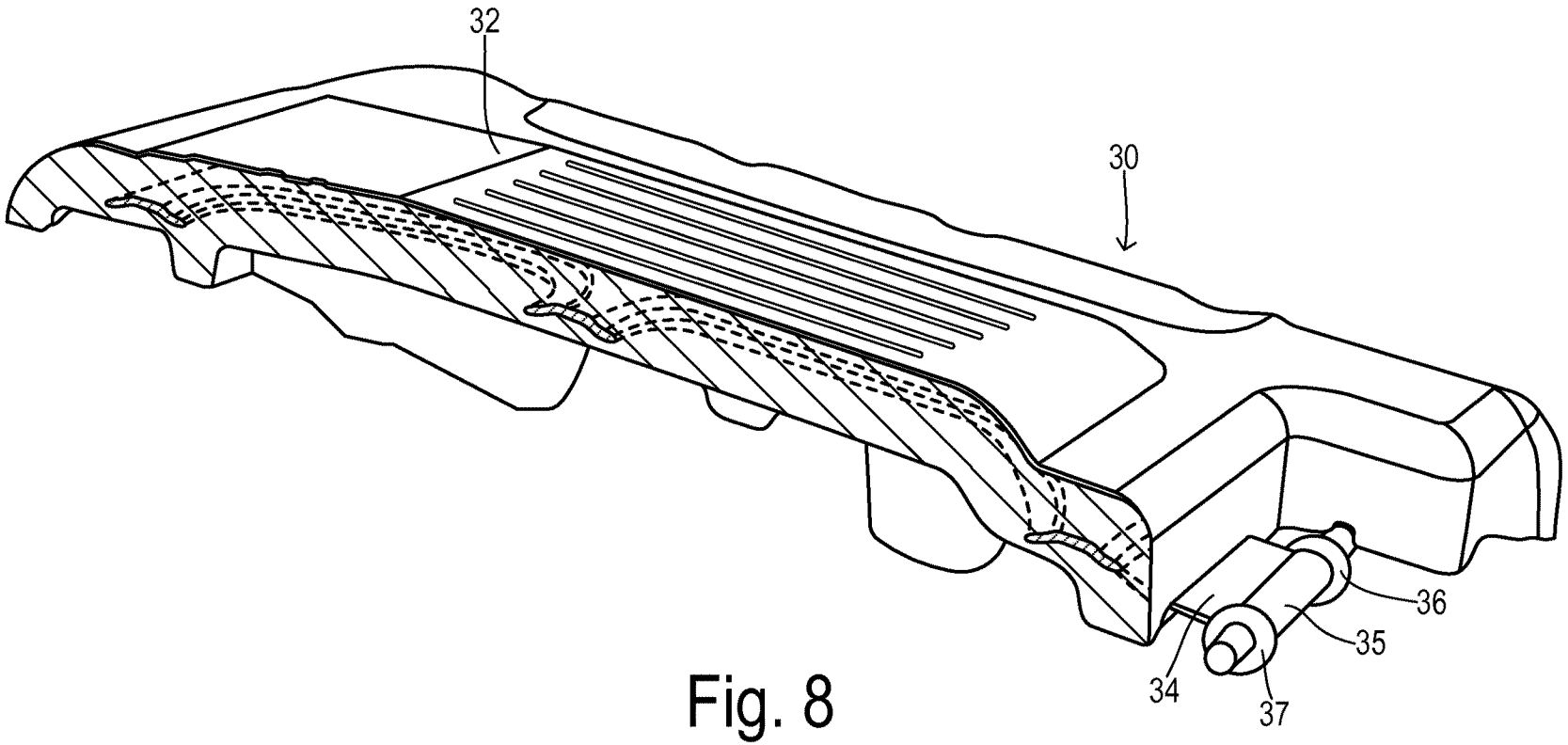
FIG. 8 is a cross-section view of the cover of FIG. 7.
Figure 10:
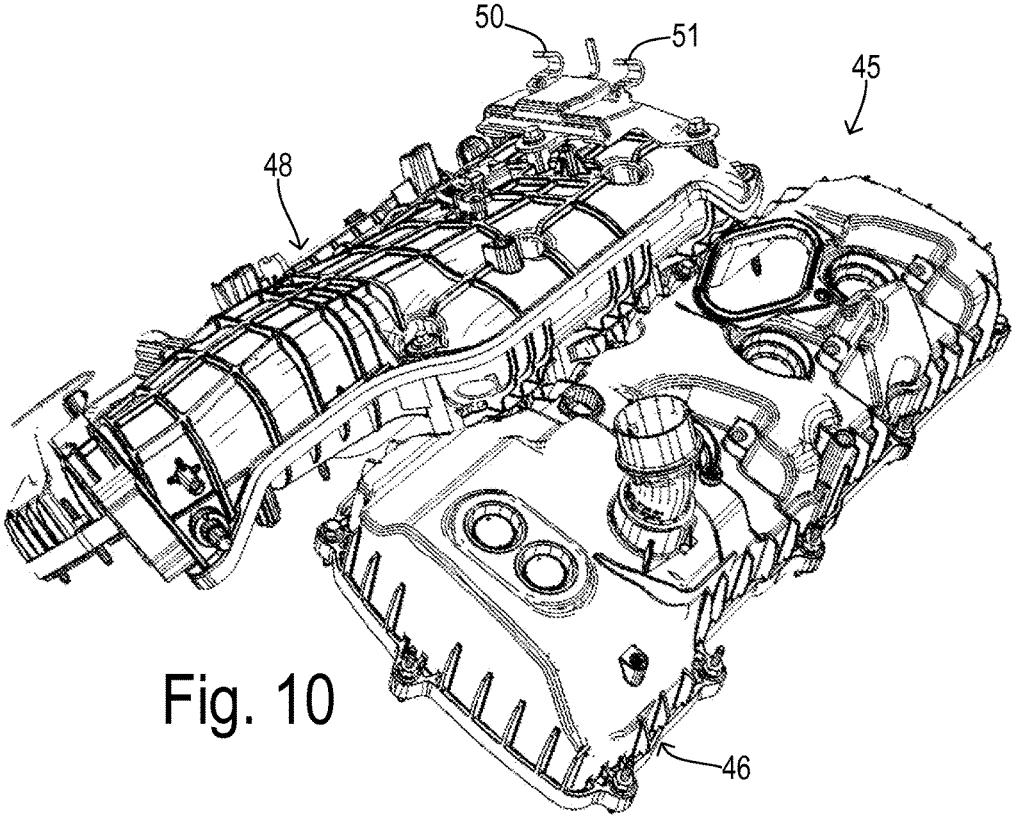
FIGS. 10-13 are perspective views of an engine assembly with structural projections for joining with the sockets in the cover.
Figure 11:
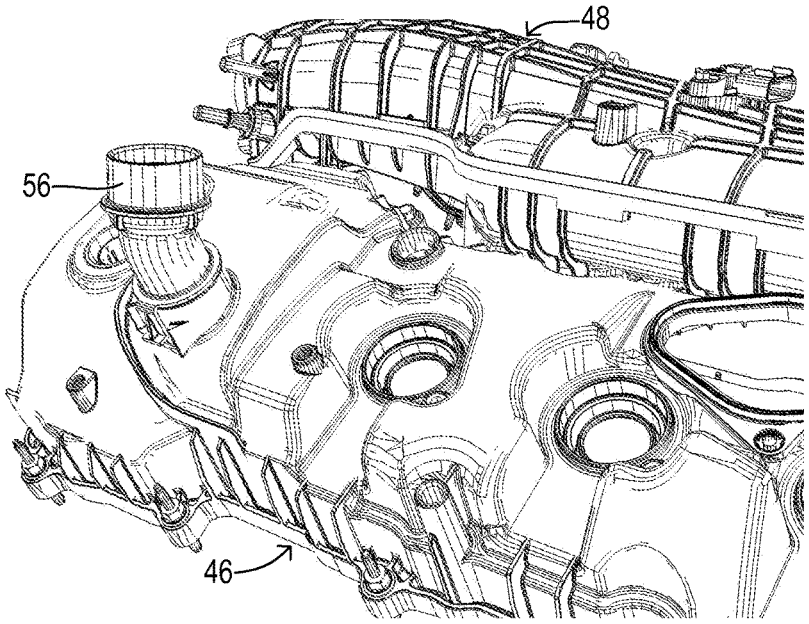
Figure 12:
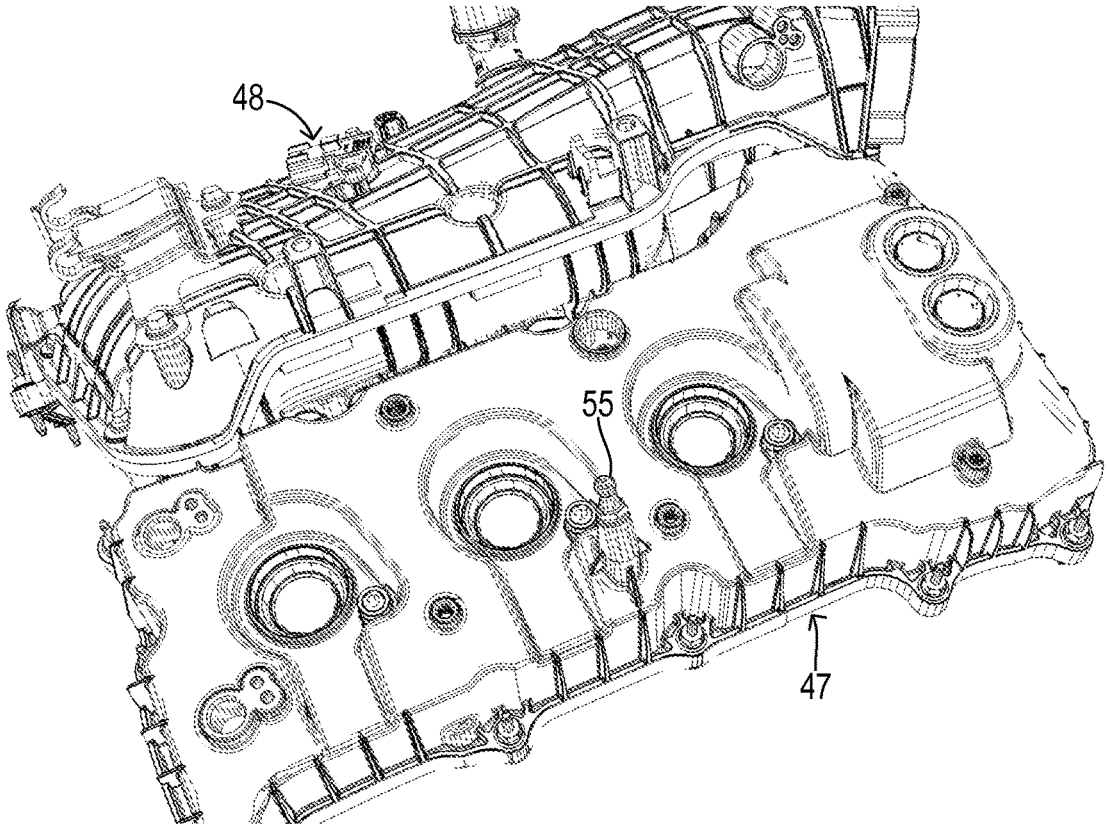
Figure 13:
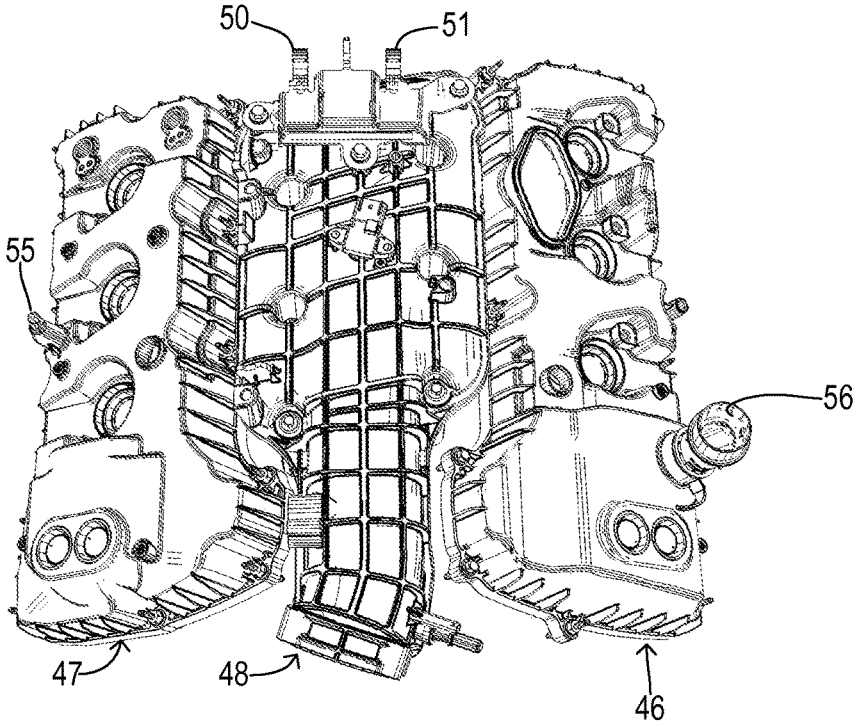

FIGS. 2-4 show improved hinged engine covers as disclosed in the patent applications cited above wherein hinge features are provided at the back end of the engine (e.g., on the air intake manifold) and back end of the cover, and wherein removable fasteners retain the front end of the cover. Thus, an air intake manifold 15 has integrally-molded hinge features 16 for attaching a cover 17 which eliminates the need for a bracket and fasteners at the back end of an engine assembly. Intake manifold 15 may be formed by injection molding a polyamide thermoplastic such as nylon, and may preferably include a filler material such as glass fiber. Hinge features 16 may be associated with a plurality of structural ribs projecting outward from manifold 15, for example. After engaging cover 17 with hinge features 16, it is tilted downward and fastened in place over intake manifold 15 and the rest of the engine assembly by fastening a bolt 18 through a corresponding hole in cover 17 and into a threaded bore 19 on intake manifold 19 at the forward end of the engine assembly. FIGS. 3 and 4 show an embodiment wherein a pivot pin 21 of a cover 20 is configured to mount to C-hooks 22 and 23 in order to form a hinged attachment between cover 20 and an air intake manifold body member 24.

A composite engine cover 30 is shown in FIGS. 5-9. Cover 30 has a rigid substrate 31 which is overmolded by a foam body 32. Rigid substrate 31 preferably includes a generally rectangular frame 33 with a tab extension 34 extending from one end to a molded pivot pin structure 35 to create a portion of a hinge that joins with an engine assembly (not shown). Frame 33 may include overmolded cross-braces 38 following the overall shape of cover 30. Pivot pin 35 includes alignment flanges 36 and 37 for bearing against corresponding surfaces of a hinge feature on the engine assembly in order to align cover 30 at a desired location.

Tab extension 34 projects out from foam body 32 so that pivot pin 35 is not be covered by the overmold. Substrate 31 is preferably molded from nylon or other rigid thermoplastic material, but could also be formed of metal or other rigid materials. Foam body 32 is preferably formed of a polyurethane foam, wherein foaming provides flexibility and improved damping characteristics for attenuating noise and vibration. Foam body 32 has an appropriate size and shape to cover and rest upon the engine assembly, and may be molded with decorative features, logos, or other graphical or textual information. In addition, the compliance/flexibility of foam body 32 is used to create mounting features not needing additional fastener components. In this embodiment, foam body 32 has first and second sockets 40 and 41 for releasably receiving corresponding projections formed on the engine assembly (described below) to hold cover 30 at its installed position. Depending on the structural projection being utilized, socket 40 and 41 may be comprised of a grommet pocket partially penetrating foam body 32 from an underside as shown by socket 40 or may be a passageway extending completely through foam body 32 as shown by socket 41. The compliance of foam body 32 allows sockets 40 and 41 to stretch in a manner that admits and then captures the corresponding structural projection from the engine assembly.

FIGS. 10-13 show an engine assembly 45 adapted to receive cover 30. Engine assembly 45 may include a pair of cam covers 46 and 47 and an air intake manifold 48 to provide the structural features for the mounting of cover 30, but other engine components could alternatively be used. In this embodiment, a pair of hinge C-shaped hooks 50 and 51 extend from the intake manifold 48 at a top, rearward end of engine assembly 45 (i.e., at the rear of an engine compartment of the vehicle) configured to receive pivot pin 35 of cover 30. The spacing and/or width of C-hooks 50 and 51 are adapted to interface with flanges 36 and 37 on pivot pin 35 in order to properly align cover 30 for installation onto engine assembly 45. For example, flanges 36 and 37 may fit against the inside edges of C-hooks 50 and 51 while pivot pin 35 extends beyond flanges 36 and 37 to engage interior slots of C-hooks 50 and 51.

A first structural projection from engine assembly 45 is comprised of a ball stud 55 extending vertically upward from cam cover 47. A ball at the end of ball stud 55 is captured by grommet pocket 40 on the underside of foam body 32. Preferably, interior dimensions of grommet pocket 40 may be configured to match the outer profile of ball stud 55. Ball stud 55 may be a molded plastic component with its base installed in a matching bore on cam cover 47 by an interference fit, for example.

Figure 14:
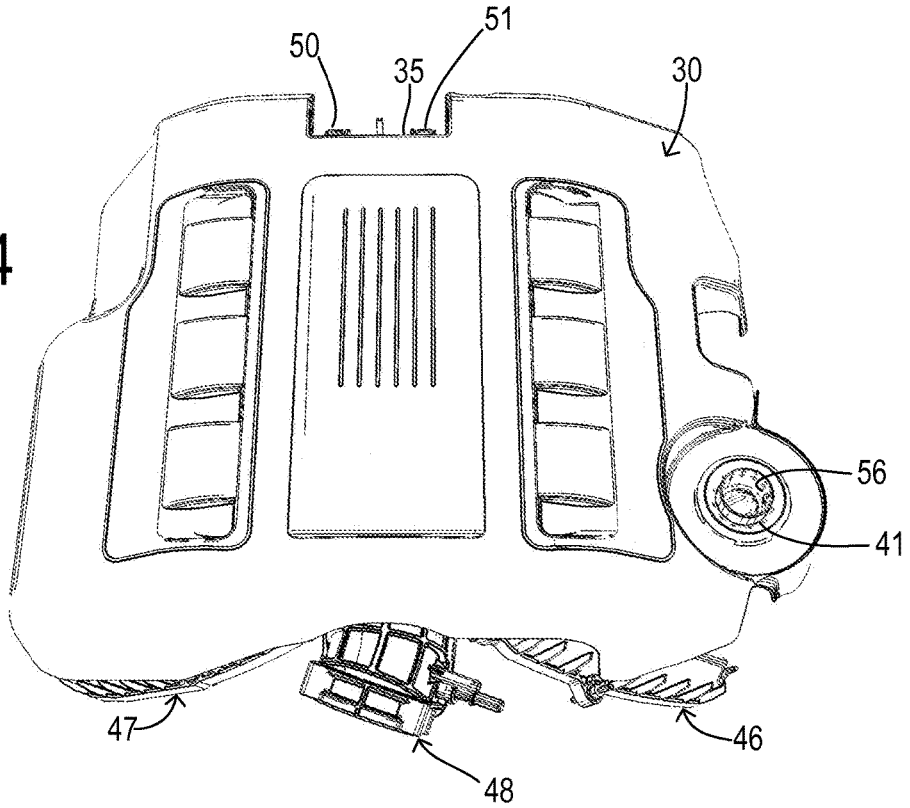
FIG. 14 is a top, perspective view of the cover installed on the engine assembly.

A second structural projection from engine assembly 45 is comprised of an oil filler neck 56 extending vertically upward from cam cover 46. Corresponding socket 41 on cover 30 comprises a passageway extending through foam body 32 having an internal diameter slightly less than an external diameter of filler neck 56. Filler neck 56 is snugly captured by the passageway of socket 41 in order to hold cover 30 at its installed position as shown in FIG. 14.

The foregoing invention combines 1) a hinge and internal frame having sufficiently rigidity to positively align and retain the cover, and 2) a soft covering body with excellent noise and vibration performance together with a desired visual appearance. Manual installation and removal of the cover is done easily and without any tools or removable fasteners.

What is claimed is:

1. Apparatus for a motor vehicle, comprising:

an engine assembly having a first hinge portion located at a top, rearward end of the engine assembly, and having first and second stationary structural projections extending upwardly and spaced from the first hinge portion; and a decorative cover comprising a rigid substrate and a foam body overmolded onto the substrate, wherein the substrate comprises a frame portion covered by the foam body, an integral second hinge portion outside the foam body, and a tab extension integrally joining the frame portion and the second hinge portion, wherein the integral second hinge portion is slidably captured by the first hinge portion, and wherein the foam body has stretchable first and second sockets releasably receiving the first and second projections, respectively, so that the foam body stretches to admit and then captures the projections to hold the decorative cover at an installed position.

2. The apparatus of claim 1 wherein the first structural projection is comprised of a ball stud extending from a cam cover of the engine assembly, and wherein the first socket is comprised of a grommet pocket formed into an underside of the foam body and adapted to capture the ball stud.

3. The apparatus of claim 1 wherein the second structural projection is comprised of an oil filler neck extending from the engine assembly, and wherein the second socket is comprised of a passageway extending through the foam body and adapted to capture the oil filler neck.

4. The apparatus of claim 1 wherein the frame portion is substantially rectangular, and wherein the second hinge portion is comprised of a molded pin at an end of the tab extension extending from the frame to emerge from the foam body.

5. The apparatus of claim 4 wherein the first hinge portion is comprised of a pair of C-hooks extending from an intake manifold of the engine assembly to receive the molded pin.

6. The apparatus of claim 1 wherein the first and second projections extend from at least one cam cover of the engine assembly.

7. The apparatus of claim 1 wherein the foam body is comprised of polyurethane foam.

8. The apparatus of claim 1 wherein the rigid substrate is comprised of a molded plastic.

9. The apparatus of claim 8 wherein the plastic comprises nylon.

* * * * *